US005656152A

United States Patent [19]

McLaughlin et al.

[11] Patent Number: 5,656,152

[45] Date of Patent: Aug. 12, 1997

[54] WATER WASHING TO REMOVE SALTS

[75] Inventors: Bruce D. McLaughlin; Yiing-Mei Wu, both of Sewell, N.J.

[73] Assignee: Mobil Oil Coporation, Fairfax, Va.

[21] Appl. No.: 349,652

[22] Filed: Dec. 5, 1994

[51] Int. Cl.[6] ..... C10G 57/00

[52] U.S. Cl. ..... 208/95; 208/177; 208/178; 208/208 R; 208/251 R; 208/254 R; 208/47; 208/DIG. 1; 585/950; 95/149; 95/230; 95/232; 95/233; 95/234; 95/235

[58] Field of Search ..... 208/95, 177, 178, 208/208 R, 251 R, 254 R, DIG. 1, 47; 585/950; 95/149, 230, 232, 233, 234, 235

[56] References Cited

U.S. PATENT DOCUMENTS

| | | | |
|---|---|---|---|
| 2,212,581 | 8/1940 | Babin | 196/134 |
| 2,446,040 | 7/1948 | Blair, Jr. | 208/251 R |
| 2,929,772 | 3/1960 | Gilmore | 208/99 |
| 4,098,675 | 7/1978 | Pope | 208/108 |
| 4,141,816 | 2/1979 | Crowley et al. | 208/107 |
| 4,880,568 | 11/1989 | Staley et al. | 252/548 |

OTHER PUBLICATIONS

Materials Performance, vol. 32, No. 6, Jun. 1993 "A New Form of Localized Corrosion".

Oil & Gas Journal—Jan. 3, 1994, (pp. 38–41) "Calculations Estimate Process Stream Depositions" Author: Yiing-Mei Wu.

AIChe Annual Meeting, Atlanta, Georgia, May 1994.

*Primary Examiner*—Glenn A. Caldarola
*Assistant Examiner*—Walter D. Griffin
*Attorney, Agent, or Firm*—Malcolm D. Keen; Thomas W. Steinberg

[57] ABSTRACT

A continuous water washing process for removing salts from refinery process streams is disclosed. The salt and salt precursor content of a process stream is determined, and iterative calculations made to ensure an aqueous phase forms downstream of the water injection point with a salt and ion concentration within acceptable limits. Preferably chemical speciation calculations are used to check for corrosive, transient aqueous phases intermediate the point of water injection and the process outlet.

17 Claims, No Drawings

WATER WASHING TO REMOVE SALTS

FIELD OF THE INVENTION

This invention relates to removing salt deposits from refinery and petrochemical streams by water washing and minimizing corrosion during water washing.

BACKGROUND OF THE INVENTION

Petroleum refiners have been removing salts from crude oil and product fractions almost since the dawn of refining.

Crude oil contains salts and salt precursors such as nitrogen and sulfur compounds. Generally, this salt consists of a mixture of sodium chloride, magnesium chloride, and calcium chloride. Salt is removed upstream of fractionation equipment to prevent corrosion and plugging in columns and associated equipment. Simple water washing will remove most of these chloride salts, and most refiners now use "desalters."

Modern refining techniques also produce salts or sometimes introduce salts into process streams.

The main source of the produced ammonium salts is chemical reactions between an acidic or basic compound dissolved in the oil and an acid or base added or created during refinery processing. Thus nitrogen and sulfur compounds in the feed are frequently converted to hydrogen sulfide or ammonia. Another impurity, hydrogen chloride, can be produced by hydrolysis of calcium and magnesium chlorides or by hydrogenation of organic chlorides. Ammonia will react with hydrogen sulfide and hydrogen chloride to produce ammonium hydrosulfide and/or ammonium chloride, respectively.

Salts can be introduced into a refinery stream when a catalyst contains leachable alkaline or acidic components. Thus platinum reforming catalyst can introduce chlorine into reformate and to the reformer off gas.

These salts, regardless of source, can form either solid deposits or an aqueous phase if water is present.

Although salt deposits, or formation of salt solutions, might seem like minor problems the opposite is the case. Salt deposits can plug distillation column internals, and shut down an entire refinery. The salts are also hygroscopic and attract water to form extremely corrosive regions. Corrosive salt solutions can and do eat holes in refinery vessels.

As an example of how serious the problem can be, on May 5, 1988 at about 3:30 a.m. an explosion occurred at a Louisiana refinery which resulted in 7 fatalities, 28 injuries, and significant property damage.

A depropanizer associated with a large FCC unit had experienced condenser fouling. To control fouling (salt buildup in the condenser tubes) water washing was begun. Wash water containing ammonia was injected into the vapor stream to maintain the pH in the condenser boot between 6.5 and 8. Despite use of an alkaline water wash, a localized region of high $H_2S$ absorption and $H_2S$ acidification developed downstream of the water injection nozzle. The resulting iron sulfide corrosion products were a porous scale at this point in the pipe, which allowed more $H_2S$ to accumulate. The net result was that about 100 square inches of metal was ejected from an 8" pipe elbow about 1.1 m downstream of the water injection nozzle. This depressured the depropanizer into the refinery, forming a vapor cloud which exploded. More details of the failure are reported in the paper entitled "A new form of localized corrosion" in Materials Performance Vol. 32, No 6, June 1993, which is incorporated by reference.

It is also worth noting that although the explosion occurred in May of 1988, it took roughly five years, until June of 1993, to publish the report, which refers to "unpredictable high rates of $H_2S$ absorption at the turbulent periphery of the water splash zone . . . . "

This paper and the disaster exemplify the state of the art in refinery processing, namely controlling water injection based on boot water pH, and relying on inspection to check for localized corrosion problems. Such a retrospective approach can lead to tragic results, though it may be that nothing could have prevented the localized corrosion which occurred in that FCC unit.

We discovered that much of the corrosion that occurs in refinery and chemical process equipment is predictable and avoidable. Before getting into our new method of controlling water washing, it is instructive to review salt formation or introduction and conventional practices associated with salt removal. The review is by no means complete, but illustrates some of the complexities of salt formation and removal. Salt formation in two "wet" processes (crude distillation and hydrotreating) and one "dry" process (catalytic reforming) will be considered.

SALT FORMATION DURING CRUDE DISTILLATION—WET PROCESS

In a typical crude unit, the whole crude passes through one or more stages of heat exchange. The crude is heated to some extent, and heat is recovered from various product and/or reflux streams. The crude is then desalted by mixing with water and separation, which may involve electrostatic precipitation to help remove water droplets. Desalting significantly reduces, but does not eliminate, the salt content of the crude. Desalting can add some undesirable materials to the crude. Desalting uses refinery water streams, which frequently contain dissolved and/or entrained species which can enter the crude oil either by entrainment or via liquid/liquid extraction.

Desalting is never perfect, so significant amounts of salt always remain in the crude. In most crudes these salts are primarily calcium and magnesium chlorides. While desalting involves a water removal stage, there is always some water entrained and/or dissolved in the crude after desalting.

The desalted crude, still containing some calcium and magnesium chlorides and with entrained water added by the desalting step, is then further heated by heat exchange with various hot product streams from the atmospheric tower, the vacuum tower or both. The heat exchanged crude then passes through a direct fired heater to the atmospheric tower where the vaporized distillate is fractionated into various product fractions.

In most refineries stripping steam is added to the atmospheric tower, to product strippers associated with the atmospheric tower, to the vacuum tower and to product strippers associated with the vacuum tower. Steam aids fractionation, in part by creating a "pseudo vacuum". If half the atmosphere in a tower is steam, the hydrocarbon partial pressure is reduced, so that the tower operates as if it were at a lower pressure.

Most refineries recover a gasoline overhead product, naphtha, kerosene, light gas oil, heavy gas oil, and a residual or bottom fraction. The gasoline overhead product is condensed and pumped to a stabilizing system. The liquid streams of naphtha, kerosene etc. pass through strippers and further treating facilities. The bottoms may be used as fuel, or sent to a vacuum distillation unit to recover a vacuum gas oil fraction from a vacuum resid bottoms product.

The crude contains impurities that contribute to ammonium chloride and hydrosulfide salt formation. The impurities generally include sulfur, chlorine and nitrogen compounds which are discussed below.

Sulfur Compounds

Sulfur compounds are present in all crude oils. During high temperature processing, such as occurs in the fired heater and in the lower regions of the crude column, some of the sulfur compounds decompose to form hydrogen sulfide, a key ingredient in hydrosulfide salts.

Chlorine Compounds

Hydrogen chloride can be produced by a variety of reaction mechanisms:

1. hydrolysis of calcium and magnesium chlorides,
2. metathetic reaction between sodium chloride and organic acids, and
3. hydrogenation of organic chlorides.

Nitrogen Compounds

Ammonia enters the crude unit primarily through the desalter wash water. The desalter wash water usually contains about 50 to 100 ppm of ammonia. Since the desalted crude will always have some entrained water, ammonia is invariably carried into the crude tower. Another source of ammonia is hydrogenation of organic nitrogen compounds present in the crude, which can occur to some extent during distillation.

Ammonia and hydrogen chloride can react as they travel up the crude tower to produce ammonium chloride. Copious amounts of ammonium chloride can also be formed in the overhead system itself if ammonia is added as an overhead neutralizer. At lower temperatures this ammonium chloride can precipitate as a solid, directly from the vapor phase, in the upper portions of the atmospheric tower or in the overhead system.

The immediate result is fouling. The fouling can be so severe that there is a significant increase in pressure drop through the column and overhead system. This is usually followed by underdeposit corrosion. Ammonium chloride deposits are hygroscopic, meaning they tend to abstract water from the vapor phase to form a saturated solution of the chloride salt. Saturated solutions of ammonium chloride are acidic and highly corrosive.

Ammonia present in the column, or overhead system, may also react or combine with hydrogen sulfide to form ammonium hydrosulfide, sometimes called ammonium bisulfide. Like ammonium chloride this salt precipitates directly from the vapor phase, forming deposits of ammonium hydrosulfide. Ammonium hydrosulfide is also hygroscopic, so such fouling is usually followed by underdeposit corrosion.

Refiners are aware of the problems of fouling and corrosion in the crude unit and work hard to prevent or at least deal with it. Most refiners use chemical additives such as neutralizer/corrosion inhibitor injection or water wash or a combination of both. The water injection rate is usually based on some "rule of thumb". The typical place for water injection is usually upstream of one of the overhead condensers associated with the column, though usually with no thought to thermodynamic or chemistry considerations.

Plugging of the overhead lines, and less frequently of the tower trays, has been experienced by refiners who picked the wrong injection locations. Additional problems were possible if an incorrect amount of water was added.

If not enough water is injected, or if the flowing stream is too hot and vaporizes all the injected water, then solid salt deposition may occur where there is no aqueous phase present to dissolve the salt. Salts will deposit, followed by corrosion under the salt deposits. Similarly if water is added in the proper amount but too late then fouling may occur upstream of the point of water injection.

Yet another possibility is that enough water will be injected to dissolve salts as they deposit, but not dilute them sufficiently. This produces a corrosive concentrated salt solution. Adding too much water generates unnecessary amounts of waste water.

Unfortunately, the way modern refineries operate there is no way to avoid this problem during crude fractionation. Crude oil always has some salt in it, and some water either dissolved, entrained or in the form of a stable emulsion sometimes called bottoms settlings and water, BS&W. Eliminating desalting might reduce the amount of entrained water attributable to desalting charged to the crude column, but would increase the salt load on the column. Operating with multiple stages of desalting, or hotter water during desalting, would reduce salt content of the crude, but there would still be some salt and likely more water entrainment. There could be more water and more ammonia fed to the crude column even as salt traffic was reduced. This may increase the likelihood of a water phase forming prematurely in the overhead system and promote formation of ammonium compounds.

To summarize, there is no way known to eliminate salts from the crude column. The crude column is inherently wet, at least in the overhead stages, so both salt deposition and salt solution corrosion must be considered.

Other types of processes besides crude distillation have salt deposition problems, even when hydrocarbon charge to the refinery process is essentially free of salts. Salts can be produced catalytically during some refinery processing steps. An example of such a process, discussed in more detail below, is hydroprocessing.

SALT FORMATION DURING HYDROTREATING—WET PROCESS

Hydrotreating typically takes a relatively dirty but dry feed containing significant amounts of sulfur and nitrogen and removes same by treatment over a catalyst containing hydrogenation/dehydrogenation metals on a porous support in a hydrogen atmosphere. Although the feed can be very dry, as passage through multiple distillation columns would efficiently dehydrate the feed, large amounts of salts are expected. Significant amounts of water are always injected to wash out salts formed during the reaction. Usually the water is added to the reactor effluent line. Hydrotreaters are therefore almost invariably "wet" downstream of the water injection point.

It might seem that such salts, which are readily dissolved in water, could be dealt with easily—merely add water to wash the salts out as they form. In practice things are not that simple—if a refiner adds too little water a highly corrosive salt solution forms. If water is added too late, solid salt deposits will form upstream of the water injection point. If water is added too soon (when the process stream is too hot), all the water may evaporate.

Highly corrosive transient streams may also form in some parts of the equipment, but not appear corrosive in the boot of the V/L separator associated with the hydrotreater.

If extremely large amounts of water are added, there is loss of energy, and the size and cost of the refinery waste water treatment facility are greatly increased.

In practice most refiners adopt various "rules of thumb" to determine hydrotreater water wash practices. Typical practice is to inject 1 gallon per minute of water per thousand barrels per day of oil processed. For a distillate hydrotreater processing 10,000 BPD of oil feed, 10 GPM of water is injected between the reactor and the vapor/liquid separator associated with the hydrotreater.

Refiners couple such standardized addition procedures with annual inspections of all piping for corrosion. The belief is that if there are any problems with water injection, the annual inspection will locate problems in time so that corrective action may be taken.

Some refiners also add amine film forming agents in the belief that the amine film which forms on metal surfaces will protect the process equipment.

The problem of salt deposits in the "wet" units discussed above is quite different from the problems encountered in "dry" units such as Pt catalytic reformers. In a dry unit, there can be a salt deposition problem even when no salts are in the feed, nor are any salts inherently formed as a byproduct of the reaction. In some units, the catalyst can leach chlorides or other materials which can react with other compounds found in the flowing hydrocarbon stream to form salts. These dry units present special problems, because salt deposition may be so slow as to be barely observable, but sufficient to plug eventually downstream processing equipment. Some of the obvious solutions, such as adding a large amount of water, may actually exacerbate corrosion of metal surfaces, and create orders of magnitude more waste water than is necessary. This phenomenon can be better understood by considering the problem of salt deposition in Pt reforming, a process considered "dry", which is reviewed next.

SALT FORMATION DURING REFORMING—DRY PROCESS

Pt reforming is a dry process. Reformer feed is a clean, hydrotreated material. Even such clean processes can have a significant salt problem, but here much of the salt formation is attributable to the refinery process, catalytic reforming, rather than to the presence of impurities in the feed.

Catalytic reformers pass hydrotreated feed over chlorine containing Pt Catalyst. Chlorine, or possibly some other halogen, is part of the reforming catalyst to impart the desired acidity to the catalyst. Some of this chlorine is "washed" or leached from the catalyst, even though the reforming reaction atmosphere is dry, i.e., has less than 100 ppmv $H_2O$. Chlorine reacts with the minor amounts of ammonia, etc. present in reformate to form chlorine salts which deposit in the reformer fractionator impairing its operation.

Refiners have tried to cope with the problems of chlorides in reformate using a variety of approaches, reviewed below.

1. Water Washing

Water washing of a depropanizer associated with a continuous catalytic reformer was reported in Example 2 of U.S. Pat. No. 4,880,568. Periodic water washing for a severe fouling and corrosion problems was not effective so "an elaborate continuous water wash system was installed. The continuous water wash system also failed to solve the deposit problem."

Continuous water washing can create a corrosion problem where none existed before. In a dry atmosphere, chlorine salts are not corrosive, though they will plug equipment. As soon as water is added, a corrosive salt solution forms, and unless all the chlorine salt is removed the salts left unwashed will be soaked with water and highly corrosive.

One of our refineries tried using an aqueous, alkaline treatment of the reformate liquid upstream of the debutanizer. A dilute caustic was injected into reformate intermediate the V/L separator and the debutanizer. The caustic was less than 15° or 20° Be (or roughly 10 to 15 wt % NaOH). A mesh pad was used to aid in separation of caustic/reformate in a separator vessel. The experiment was not considered a success as a flow control valve corroded, and the experiment was stopped.

The engineer responsible for the reformer at this refinery was very concerned about using water injection to remove chlorides, primarily because the dry reformate stream was not corrosive, but it became corrosive if water injection was used. Two other approaches were considered, solid bed treating and chemical treatment. These approaches are reviewed next.

2. Solid Adsorbent Treating

Some refiners use beds of solid adsorbent to prevent chloride corrosion and fouling. More details about this are available from UOP Inc. Des Plaines, Ill., which has approved use of at least one type of solid adsorbent to remove chlorides from reformate.

Solid adsorbent beds can cost a lot. They can also plug, and many refiners are reluctant to use that approach.

3. Chemical Treatments

Several patents are directed at treatment chemicals which can be injected into the reformate stream. These chemicals inhibit the formation of ammonium chloride to keep chlorine compounds in a form which will not precipitate as a solid in process equipment. Some chemical treatment programs also include chelating agents and/or film forming agents to prevent further corrosion.

U.S. Pat. Nos. 5,282,956 and 5,256,276, which are incorporated by reference, disclose inhibiting ammonium chloride deposition by adding an amide such as 1,3-dimethyl-2-thiourea or phosphatide such as lecithin.

U.S. Pat. No. 4,880,568, METHOD AND COMPOSITION FOR THE REMOVAL OF AMMONIUM SALT AND METAL COMPOUND DEPOSITS, Staley et al, Assignee: Aqua Process, Inc., Houston, Tex. taught injecting amines and chelating agents into reformate to remove and/or prevent formation of ammonium salt deposits. Amines added form amine salts with a low melting point or an affinity for trace amounts of water. This patent is incorporated by reference.

While adding chemicals to prevent formation of ammonium chloride deposits and/or chelating agents to remove metal corrosion products will help, such approaches are expensive and are not considered the ideal solution. Film forming agents may still be needed to protect metal surfaces in process equipment.

The state of the art could be oversimplified and summarized as follows:

In a dry process such as reforming salt removal generally focusses on removing salt deposits before equipment plugs, but without forming a corrosive salt solution in an otherwise dry stream.

In wet processes, formation of an aqueous solution is considered probably inevitable, so refiners must determine the optimum place and amount of water to add.

Sometimes it is difficult to tell if a process is "wet" or "dry". Most refiners know that Pt catalytic reforming is dry, and that the crude column overhead system is "wet", but it is not easy to determine where other refinery processes fit in this classification scheme.

An incorrect guess can lead to inappropriate treatment. If a unit, or part of a unit is relatively dry, continuous water washing may eliminate a fouling problem but create a corrosion problem (if the salts dissolve in the wash water to form a corrosive solution) and a disposal problem. Thus it may be best to let salts deposit and wash the unit only intermittently. The water washing will still create a corrosive salt solution, but washing may be needed only a few hours a week. The amount of corrosion occurring in such a short period will usually not be significant, and production of waste water from washing can be greatly reduced as compared to continuous water washing.

Intermittent water washing, however, creates additional problems. Once water washing has started it must not be stopped until all the deposited salts are washed out. Leaving some salt deposits in the unit will usually cause under-deposit corrosion, due to the hygroscopic nature of the salts, so complete removal of salt deposits is crucial in an intermittent injection situation.

We looked at this chaotic situation, and discovered a better way to deal with the problem of salts in process streams.

No longer do refiners have to wait for problems to develop, with possibly catastrophic results. Now our technique can be used to more reliable determine one or more of:

1. the most suitable injection point location;
2. the amount of water needed to create an aqueous phase just downstream of the water injection point and the corrosiveness of the aqueous phase formed;
3. parts of the unit downstream of the water injection point where corrosion is most likely to occur; and
4. whether continuous or intermittent water injection is the optimum wash procedure.

BRIEF SUMMARY OF THE INVENTION

Accordingly, the present invention provides a process for injecting water into a process stream flowing from an inlet at a temperature to an outlet at a lower temperature which contains salts salt precursors or compounds which form deposits of impurities upon cooling comprising determining the composition of impurities in the process stream, calculating an initial deposition temperature at which impurities start to deposit in the process stream, selecting an initial water injection rate and a starting point for water injection where the process stream temperature has a starting point temperature which is the higher of a temperature less than 350° F. or the initial deposition temperature, calculating at the starting point of water injection an adiabatic flash temperature using the initial water injection rate and the initial stream temperature, calculating if sufficient water was injected to produce an aqueous phase equal to at least 3 wt % of any liquid hydrocarbon phase which may form or be present and an ion concentration less than a preset maximum, and repeating the adiabatic flash calculation with an adjusted water injection rate until both of the conditions are satisfied, accepting as a designated amount of water injection an amount of water which produces an aqueous phase equal to at least 3 wt % of any liquid hydrocarbon phase present or formed and having an ion concentration no more than a predetermined maximum mole %, and injecting the designated amount of water into the process stream at the starting point for water injection.

In another embodiment, the present invention provides a process for determining a minimum temperature in a flowing process stream at which water washing must be initiated to prevent solid deposits of impurities defined as at least one salt or salt precursor selected from the group of HCl, $NH_3$, and $H_2S$ and mixtures thereof which form solid deposits upon cooling the process stream flowing through a line or vessel from an inlet at an inlet temperature and pressure to an outlet at a lower temperature comprising analyzing the process stream to determine a concentration of HCl, $NH_3$ and $H_2S$, selecting an initial water injection point in the flow line or vessel and determining a process stream initial temperature and initial pressure at the initial water injection point, calculating, by an isothermal flash calculation at the initial temperature and pressure, the partial pressures of HCl, $NH_3$ and $H_2S$, determining a product of the partial pressures $P(HCl)*P(NH_3)$, and $P(NH_3)*P(H_2S)$ where $P(HCl)$, $P(NH_3)$, and $P(H_2S)$ represent the partial pressures of HCl, $NH_3$ and $H_2S$, respectively, comparing the partial pressure products with a corresponding equilibrium constant at the same temperature to determine if the vapors are stable phases or will cause salt deposition, reducing the initial temperature to a reduced initial temperature if products of the vapor phases produce stable vapor phases and repeating the isothermal flash calculations until a salt deposition temperature is reached at which an unstable vapor phase is indicated which causes salt deposition, selecting a minimum temperature for water injection which is greater than the salt deposition temperature, and injecting water into the flowing process stream at a point in the line or vessel where a temperature of the process stream is greater than or equal to the minimum temperature.

Preferably the concentration of dissolved ionic species and a pH of the resulting aqueous phase are calculated by determining the composition of impurities in the process stream and in the injected water, then performing speciation calculations by calculating HA=A(−)+H(+)* with an equilibrium constant K equal to a concentration of A(−)* concentration of H(+)/concentration of HA, then calculating the sum of ions in the aqueous phase by adding chloride ions, ammonium ions, hydrosulfide ions, and sulfide ions, and then calculating a hydrogen ion concentration and pH in the resulting aqueous phase.

Preferably a pH in the resulting aqueous phase is calculated and compared to a target pH in the range of 5.5 to 7.5 and the designated amount of water is increased to achieve a pH within the target range. A pH control chemical may be injected into the process stream or with injected water to achieve a pH within the target range.

Preferably there is checking for transient conditions of ion concentration at an intermediate point, downstream of the initial point of water injection and upstream of the outlet by performing at least one adiabatic flash temperature and chemical speciation calculation at an intermediate temperature corresponding to at least one location of the process stream downstream from the starting point for water injection but at a temperature greater than or equal to a terminal process temperature at which water separation and removal occurs and increasing the amount of water injection and repeating the calculation until the resulting aqueous phase has an ion concentration of no more than 2 mole %.

Preferably there is checking for transient conditions of pH by performing at least one adiabatic flash temperature and chemical speciation calculation at an intermediate temperature at at least one location downstream from of water injection but a temperature greater than or equal to a terminal process temperature at which water separation and removal occurs and calculating a pH in said aqueous phase at said intermediate temperature and comparing same to a target pH in the range of 5.5 to 7.5; and adjusting pH at said point by injecting more water, injecting a pH control chemical with said injected water, or adding a pH control chemical to said process stream to achieve a pH within the target range in the aqueous phase at the intermediate temperature.

An adiabatic flash calculation and ion concentration calculation are preferably performed at the outlet temperature and a pH in the aqueous phase at the outlet temperature calculated and compared to a target pH in the range of 5.5 to 7.5 and this pH is controlled by adjusting pH at said point by injecting more water, injecting a pH control chemical with said injected water, or adding a pH control chemical to the process stream to achieve a pH within the target range in said aqueous phase at the outlet temperature.

Preferably, when determining the minimum temperature in a flowing process stream at which water washing must be initiated to prevent solid deposits, the minimum temperature selected is at least 5° C. higher, and more preferably at least 10° C. higher, than said the determined minimum salt deposition temperature as a safety factor to ensure that water washing occurs upstream of any region of potential salt deposition.

Preferably, in addition to calculating a minimum temperature of the process stream for water injection, there is also a calculation to determine the minimum amount of water injection at that point by selecting an initial water injection rate, performing an adiabatic flash calculation based on the initial water injection rate in the process stream at at least the selected minimum temperature to calculate a flash temperature and check for the presence of an aqueous phase which forms in an amount equal to at least 3 wt % of any hydrocarbon phase which may form or be present, and has a dissolved ion concentration no greater than a predetermined maximum mole %, based on chemical speciation calculations on said aqueous phase at the flash temperature and repeating adiabatic flash and chemical speciation calculations with an increased amount of water injection as necessary to produce an aqueous phase equal to at least 3 wt % of any hydrocarbon phase formed or present and having a dissolved ion concentration no greater than said predetermined maximum mole %; and selecting a water injection rate which is at least as large as said increased amount of water injection.

When such an approach is followed, it is possible to calculate the predetermined maximum ion concentration based only on a calculation of the amount of NH4, Cl—, HS— and $S^{2-}$ in the aqueous phase.

DETAILED DESCRIPTION OF PREFERRED EMBODIMENTS

The process of the present invention may be used with any refinery or petrochemical process which has streams flowing from a high temperature to a lower temperature, whether in a piece of pipe or a large process vessel such as a distillation column.

Our process will be most useful for refinery processes considered "wet", i.e., those in which formation of a water phase is considered inevitable, and where continuous water injection will be used. Examples of such processes are crude distillation, heavy oil hydrotreating and the like.

Conceptually, all processes could be considered as a length of pipe with a salt (or salt precursor) laden process stream in fully developed turbulent flow entering the inlet at a certain temperature and leaving the pipe at a lower temperature. Cooling can be accomplished slowly (natural cooling due to radiant heat loss) or quickly (use of heat exchangers, fin fan coolers, injection of reactants or quench streams). In addition to anything else which may occur, there will be at least one injection point on the pipe where water is injected to wash out the salt. As the flow through the pipeline is considered ideal, fully developed turbulent flow, it is also assumed that there will be perfect mixing just after the injection point.

Our process focusses on what solid deposits form as the stream flows through the pipe, what happens at the point of, or immediately downstream of, the point of water injection, and on what happens at the pipe outlet, which corresponds to the water collection boot downstream of many refinery processes. Some typical "wet" refinery processes will now be reviewed.

ATMOSPHERIC CRUDE DISTILLATION

This process is well known and widely used. Crude oil, usually after desalting, is charged at roughly atmospheric pressure to a crude column, preheated by heat exchange, heated further in a fired heater, and charged to a tower or distillation column running roughly at atmospheric pressure. Water in the form of entrained water, and stripping steam, are present in the column. Temperatures range from 600° to 900° F. in the bottom of the column, to 60°–200° F. in the overhead system, depending on pressure and whether the crude was topped before being charged to the crude column.

STEAM STRIPPERS

Many atmospheric, and/or vacuum, distillation columns operate with steam strippers associated with one or more side streams. Addition of steam helps remove lighter materials, and creates more "wet" overhead streams that must be dealt with. Sometimes these overhead streams go back to the main column, while sometimes there is an independent overhead system (condenser, separator, etc.) associated with the steam stripper.

HYDROTREATING

Such processes operate at from 100 to 5000 psig, typically at 400 to 1000 psig. Hydtrotreating catalysts are available from many vendors, typically Ni, Mo, Ni/Mo on an amorphous support such as alumina or silica/alumina. Hydrotreating temperatures may vary from 300° to 800° F., or higher. Hydrogen is typically present in an amount ranging from 100 to 5000 SCFB, typically 500 to 1500 SCFB. Space velocities may range from 0.1 to 10 or more, but most run at 0.5 to 2 LHSV.

OTHER WET PROCESSES

In addition to the above, which represent some of the "wet" processes in petroleum refineries, there are many other processes in petroleum refineries as well as in petrochemical and specialty chemical plants which involve the injection of or formation of water. If the unit is built with a boot associated with a product recovery vessel, and water has to be drained from the boot on a regular basis, the unit can safely be assumed to be wet, and a candidate for our process.

CALCULATION METHODS

Our method can be implemented using conventional paper calculation techniques or sophisticated software. Because of the iterative nature of some of the calculations, use of a computer to perform some of the steps involved is preferred.

The discussion that follows presumes that the plant is one which is "wet", and that the plant operator will continuously inject water.

Two types of information are needed. First, we need to know the nature and amount of salts and salt precursors.

Some streams will not need water injection to remove salts, either because no salt deposits will form or because enough stream water is present in the stream to remove salt deposits as they form, but without forming a corrosive salt solution. Second, we need to know how the stream will respond to a prescribed regimen of water injection.

A threshold inquiry may involve an analysis of the process stream, to determine the nature and amount of the salt deposits if nothing is done (no water is injected). This helps confirm if water washing is required and, if it is, how much water injection will be needed. It provides a reasonable starting point for an initial amount of water injection which will satisfy some of the classical rules of thumb for water injection, i.e., add enough water to dissolve all the salt.

At some point we start with an initial amount of water injection, which may be a large or small amount, based on a "rule of thumb" or something approximating that amount needed to dissolve all the salt. It does not matter if the initial guess is quite wrong, our calculation method will point the way to the correct amount. We also calculate what happens to the process stream without water injection (first appearance of salt deposits), and what happens with this initial amount of water injection. This has several aspects. One aspect is how water injection changes the characteristics of the process stream, and how the process stream affects the injected water. If the process stream is large enough and hot enough to vaporize all the injected water, that is a sign that the initial amount of water injection was not enough. Another aspect is the formation of transient or permanent corrosive aqueous phase solutions. This allows us to determine the suitability of the predicted amount of water injection, and the need for further modifications.

Therefor we calculate:

1. The water dew point temperature of the process stream under investigation.
2. The first appearance temperature for each salt believed to be in the stream.
3. The deposition rate for each salt.
4. The water injection rate needed to maintain a minimum allowable aqueous phase content in any hydrocarbon phase that may form and a salt concentration below the maximum value in the resulting aqueous phase.

While the first item (water dew point) can be calculated or determined experimentally, the other items generally involve chemical speciation calculations. These items are briefly reviewed below.

WATER DEW POINT

This may be calculated using conventional techniques, or may be determined experimentally. Steam tables may be used to predict the maximum steam partial pressure possible at a given temperature. Water will condense if the stream has composition implying a steam partial pressure which equals or exceeds that predicted by the steam tables.

Chemical Speciation Calculations

Preferably this is done for all species known or suspected to be present, and is used to determine at which temperature salts will deposit, the amount of salts being deposited, and how much water injection is needed.

Many of the calculation techniques involved are the same as those used in electrochemical processing. Familiarity with the discussion on ELECTROCHEMICAL PROCESSING, Kirk-Othmer, *Encyclopedia of Chemical Technology,* 3rd Edition, Volume 8, John Wiley & Sons, 1979, pp 662–720 is presumed.

A preferred calculation method for determining the deposition starting temperature and amount is disclosed in Calculations estimate process stream depositions, Oil & Gas Journal, Jan. 3, 1994 pp 38–41, Yiing-Mei Wu (one of the inventors named herein). This article is set out below (without reference to the Figures or the equations which are substantially as set out below in the Equation Summary).

A calculation method has been developed to estimate the conditions and extent of ammonium chloride and ammonium hydrosulfide depositions in refinery process streams containing ammonia, hydrogen chloride, and hydrogen sulfide impurities.

Corrosion caused by ammonium chloride ($NH_4HS$) has long been a problem in the refining industry. Refining units that can be affected by underdeposit corrosion, or by plugging as a result of salt deposits, include the crude overhead system, hydrocracker, catalytic reformer pretreater, and hydrodesulfurization units.

These units usually process streams containing sulfur and nitrogen compounds, a portion of which will be converted to, respectively, hydrogen sulfide and ammonia. Another impurity-hydrogen chloride can be produced by hydrolysis of calcium and magnesium chlorides or by hydrogenation of organic chlorides.

Since salt deposition is a function of feedstock impurity, process temperature, and pressure, it is beneficial to be able to evaluate deposition propensity deductively for each susceptible stream. The evaluation should predict:

Where, or at what temperature, the salt starts to deposit

The kind of salt that deposits

The approximate amount of the depositions.

If salt deposition is indicated or predicted, several preventive measures can be considered to minimize any deposit related damage. These measures include:

Inspecting affected equipment more frequently (i.e., equipment downstream of the salt depositions).

Changing to a cleaner, less-susceptible feed

Installing water-washing operation to remove the deposits.

For the third option, the total amount of deposition and the location of first deposits are important process parameters. Enough wash water should be injected upstream of the first deposits to dissolve all the accumulated deposits.

Equations

Ammonium chloride and ammonium hydrosulfide deposits are formed in the vapor phase by the following reactions:

$$NH_4Cl_{(s)}=NH_{3(g)}+HCl_{(g)} \quad [1]$$

$$NH_4HS_{(s)}=NH_{3(g)}+H_2S_{(g)} \quad [2]$$

Depositions start when the vapor pressures of the reacting gases exceed certain values. Numerous researchers have measured or calculated those threshold pressures in an attempt to predict the deposition tendency.

The most reliable of these data will be presented and used to estimate the conditions and extent of those depositions. Note that this approach is purely thermodynamic. The important kinetic aspects, such as flow patterns and residence time, are beyond the scope of this work.

Most of the data used are based on ideal conditions; that is, no interaction between other species is taken into consideration. This can be justified because the reactions occur in the gas phase; thus interactive force between gas molecules should be small. One should not, however, exclude the possibility of such interactions.

Thermodynamics

The equilibrium constants or Reactions 1 and 2 can be written as:

$$K_1=P_{NH3}\times P_{HCl}$$

$$K_2=P_{NH3}\times P_{H2S}$$

where $P_{NH3}$, $P_{HCl}$, and $P_{H2S}$ are the partial pressures of, respectively, $NH_3$, HCl, and $H_2S$ in the vapor phase.

$K_1$ and $K_2$ vary with temperature. If the product of the vapor pressures exceeds the corresponding equilibrium constant at the same temperature $NH_4Cl$ will precipitate out until the vapor pressure product decreases to its equilibrium value.

In estimating these depositions, it is the product of the vapor pressures that matters. Deposition will occur even when the stream has a small amount of HCl, as long as the $NH_3$ partial pressure is high enough, and vice versa.

Another important observation is that the deposition tendency of $NH_4Cl$ is much higher than that of $NH_4HS$. For example, when temperature is 120 F., a stream with an NH3/HCl pressure product of $10^{-10}$ psia$^2$ will precipitate NH4Cl, while a stream with the same pressure product of NH3 and H2S will not precipitate NH4HS.

Deposition tendency

The first step in determining whether deposition will occur is to do an isothermal flash calculation at the temperature in question. The vapor pressure product of NH3 and HCl—and, if appropriate, NH3 and H2S—is then compared to the corresponding equilibrium value.

If the vapor pressure product so calculated lies below the equilibrium curve (in other words, in the region where the vapors are the stable phases), this procedure is repeated with a new, lower temperature. Because the equilibrium $K_p$ values for both salts decrease as the temperature decreases, lowering the stream temperature will introduce the onset of the salt deposition if the impurity concentration is high enough.

Once the stream temperature is so low that the calculated point is just above or on the curve, that temperature is defined as the deposition starting temperature. Ammonium chloride, ammonium hydrosulfide, or both, will deposit out of the vapor phase, thereupon bringing the pressure product back to the equilibrium value.

Extent of deposition

To calculate the amount of deposits formed, a stepwise approach is used.

Theoretically, when the stream cools down gradually from the deposition starting temperature, the system will undergo a continuous deposition process with infinitesimal changes in concentrations and temperature each time, so that the equilibrium conditions are always satisfied.

During continuous deposition the stream drops out whatever amount of NH4Cl is necessary to follow the equilibrium curve once the temperature is below the deposition starting temperature.

In reality, temperature changes are not infinitesimal. Supersaturation in concentrations is a common phenomenon. A stepwise decrease in temperature in the calculation therefore is employed.

NH4Cl is not formed until the system overshoots 20° F. from the deposition starting temperature. After depositing out certain amount of NH4Cl, the system is back to equilibrium. Then the next overshooting begins.

This procedure is repeated until the temperature reaches the end point (usually the water dew point). The total amount of deposits is the sum of the salt formed in each step.

Algorithm description

Using the necessary stream data (composition, temperature, and pressure), the isothermal flash temperature is determined using any process simulation software (OGJ, Jan. 14, 1991, p. 55). The partial pressures of NH3, HCl, and H2S are then calculated using Equations 1–3. The equilibrium constants K1 and K2 are also calculated using Equations 4 and 5.

Once these values have been determined, one of the following four cases is possible: No deposition, only NH4Cl deposition, only NH4HS deposition, or both NH4Cl and NH4HS deposition. Except for the first case, the amount of deposit will be calculated using Equations 6–8.

The stream composition of NH3, HCl, and H2S will be adjusted accordingly to account for the loss to solid deposits.

The deposition starting temperature will be recorded. Then the temperature is reduced by an predetermined, arbitrary increment and the calculation repeats at the new temperature. This process stops when the temperature reaches the minimum (usually water dew point or boot temperature).

The amount of deposition ($\Delta m$ or $\Delta n$) can be reported as a function of temperature or as a sum in the temperature range from starting deposition temperature to $T_{min}$.

Sample problem

A process stream at 361° F. and 430 psia is cooled after passing through the tube side of a bank of exchangers. The outlet temperature and pressure are, respectively, 225° F. and 420 psia. The stream composition is shown in Table 1.

TABLE 1

CHARACTERISTICS OF SAMPLE SYSTEM

| Component | Moles/hr |
|---|---|
| Water | 25 |
| Hydrogen | 1.012 |
| Methane | 168 |
| Ethane | 107 |
| Propane | 95 |
| isobutane | 87 |
| n-Butane | 94 |
| isopentane | 159 |
| n-Pentane | 170 |
| Isohexane | 156 |
| n-Hexane | 146 |
| Methyl cyclopentane | 114 |
| Cyclohexane | 124 |
| Benzene | 40 |
| Isoheptane | 127 |
| n-Heptane | 124 |
| $C_7$ cyclo $C_5$ | 135 |
| Methyl cyclohexane | 209 |
| Toluene | 114 |
| Iso-octane | 116 |
| n-Octane | 98 |
| $C_9$ cyclo $C_5$ | 156 |
| $C_9$ cyclo $C_9$ | 157 |
| $C_9$ aromatic | 136 |
| Isononane | 98 |
| n-Nonane | 69 |
| $C_9$ cyclo $C_5$ | 82 |
| $C_9$ cyclo $C_9$ | 87 |
| $C_9$ aromatic | 59 |
| $C_{10}$ paraffin | 73 |
| $C_{10}$ naphthene | 16 |
| $C_{10}$ aromatic | 0.01 |
| $C_{11}$ paraffin | 3 |
| $C_{11}$ napthene | 1.0E-10 |
| $C_{11}$ aromatic | 1.0E-10 |
| $H_2S$ | 5.32 |
| $NH_{30}$ | 0.06 |
| HC1 | 0.0092 |

The changes of pressure product of NH3 and HCl of the sample system as the temperature decreases are calculated. The data are the results from the isothermal flash calculations from 361° F. to the water dew point temperature, which is about 160° F.

The NH3/H2S pressure product was too small for NH4HS formation so only NH4Cl deposition was considered.

The pressure product first crosses the deposition curve at 300° F. As the temperature continues to decrease, the vapor phase becomes supersaturated with NH3 and HCl. Ammonium chloride therefore deposits out between 300° F. and 160° F.

The amount of deposits was initially high, but as the temperature decreased gradually (from 300° F. to 160° F. in 10° F. increments), less and less NH4Cl deposited out. The total amount of deposits in this sample problem (n, as calculated by Equation 6) is about $9.1981\times10^{-3}$ lb-mol/hr.

Mass Balance

All calculations typically start with a mass balance, apportioning species among all phases (usually a vapor phase, a hydrocarbon phase, and an aqueous phase).

For example, consider hydrogen sulfide. The total amount of $H_2S$ in the vapor, hydrocarbon and aqueous phases, plus any $H_2S$ related ions, must equal the total $H_2S$ content of the stream under consideration.

Equation Summary

The mass balance, and partial pressure calculations will usually involve the following Equations:

$$P_{HCl}=\frac{n_{HCl}}{n_v}P \tag{1}$$

$$P_{NH3}=\frac{n_{NH3}}{n_v}P \tag{2}$$

$$P_{H2S}=\frac{n_{H2S}}{n_v}P \tag{3}$$

$$\text{For}\quad HCL_{(gas)}+NH_{3(gas)} \xrightarrow{K_1} NH_4Cl(s)$$

$$K_1=P_{HCl}*P_{NH3} \leftarrow$$

$$K_1=\frac{[10^{A-B/(C+T)}]^2}{4} \tag{4}$$

where $A = 9.3557$, $B = 3703.7$, $C = 232$ $$\text{For}\quad H_2S_{(gas)}+NH3(gas) \xrightarrow{K_2} NH_4HS(s)$$

$$K_2=P_{NH3}*P_{H2S} \leftarrow$$

$$K_2=\frac{[10^{D(T+273)^{-1.86}+Elog(T+273)+F}]^2}{4} \tag{5}$$

where $D = -1.12606\times10^5$, $E = 4.92291$, $F = -6.68672$ $$\Delta n=\frac{(P_{HCl}+P_{NH3})-\sqrt{(P_{HCl}+P_{NH3})^2-4(P_{HCl}P_{NH3}-K_1)}}{2}\frac{n_v}{P} \tag{6}$$

$$\Delta n=\left[P_{HCl}-k\left(P_{H2S}-\Delta m\frac{P}{n_v}\right)\right]\frac{n_v}{P} \tag{7a}$$

$$\Delta m=\frac{(\delta+P_{H2S}(k+1))-\sqrt{(\delta+P_{H2S}(k+1))^2-4(k+1)(P_{H2S}\delta-K_2)}}{2(k+1)}\frac{n_v}{P} \tag{7b}$$

$$\text{where } k=\frac{K_1}{K_2},\ \delta=P_{NH3}-P_{HCl}+kP_{H2S}$$

$$\Delta m=\frac{(P_{NH3}+P_{H2S})-\sqrt{(P_{NH3}+P_{H2S})^2-4(P_{NH3}P_{H2S}-K_2)}}{2}\frac{n_v}{P} \tag{8}$$

$$R_1=\Sigma\,\Delta n \tag{9}$$

$$R_2=\Sigma\,\Delta m \tag{10}$$

-continued

NOMENCLATURE $K$ = Equilibrium constant, $mmHg^2$
$\Delta m$ = Amount of $NH_4HS$ deposit, moles
$\Delta n$ = Amount of $NH_4Cl$ deposit, moles
$n_{HCl}$ = Moles of HCl gas
$n_{NH3}$ = Moles of $NH_3$ gas
$n_{H2S}$ = Moles of $H_2S$ gas
$n_v$ = Total vapor moles
$P_{HCl}$ = Partial pressure of HCl, mmHg
$P_{NH3}$ = Partial pressure of $NH_3$, mmHg
$P_{H2S}$ = Partial pressure of $H_2S$, mmHg
$P$ = Total vapor pressure, mmHg
$T$ = Temperature, °C.

Equilibrium Relationships

Equilibrium relationships are calculated using the equilibrium constant. The technique is straightforward:

$$A+B\rightarrow C+D$$

$$K=(C*D)/(A*B)$$

Here K is the equilibrium constant, a known quantity.

Electroneutrality

Finally the whole system is checked for electroneutrality. Since we are dealing with ions, i.e., charged species, the sum of all the positive charges must be equal to the sum of all the negative charges.

While the calculations are tedious and iterative, all can be done by hand, using pencil and paper.

The calculations involved in determining when, and how much, salt will deposit can be easily made using the calculation method described in the OGJ article.

Determining the corrosiveness of these salts, or rather the corrosiveness of aqueous solutions formed in a given process stream from native or injected water, involves additional tedious work, but again it can be done by hand calculations. Fortunately, vendors have developed software programs which facilitate the calculations involved.

Process simulators are available which greatly facilitate much of the calculational effort, such as the process simulator available from SIMSCI, Simulation Sciences, Inc., Fullerton, Calif. Salt concentrations can be calculated using ElectroChem software, from OLI Systems, Inc., Morris Plains, N.J.

Sample Problem for Continuous Washing

The following example is a hydrocracker system that requires continuous water washing. Water injection rate must be determined to prevent fouling/corrosion from first stage reactor effluent at 138° C. (280° F.) and 2,800 psia. The nominal compositions of the high pressure separator bottoms and the recycle gas from a U.S. refining hydrocracker first stage were used and are shown in Table 1. The feed was characterized by petroleum cuts as pseudo pure components instead of a component-by-component approach to better describe the stream. Oxygen free, good quality washwater is injected at 38° C. (100° F.) and 2,800 psia.

(1) According to SIMSCI simulation, if 38° C. (100° F.) washwater is adiabatically mixed at 2,800 psia with a 138° C. (280° F.) process stream flowing at 14,321 mol/hr, 649 mol/hr of washwater will produce a three phase mixture at 125° C. (257° F.) in which the liquid water phase (390 mol/hr) is 3 wt % of the liquid hydrocarbon phase. The pH of the aqueous phase at that location is 7.17 and the mole percent of corrosive ions ($NH_4^+$+Cl+HS+$S^{2-}$) is 1.15 (equivalent to 1.63 wt %), which implies the aqueous phase will not cause severe corrosion problems. However, the calculated pH at the injection point is somewhat higher than the desired maximum of 6.5 for hydrocracker reactor effluents. Corrosion rate should be monitored at the injection point to detect the possible onset of a corrosive condition.

(2) If the stream from (1) is cooled to 38° C. (100° F.), the pH increases to 7.83 and the mole percent of ammonium, chloride, hydrosulfide and sulfide increases to 4.90 (equivalent to 6.80 wt %). The ionic concentration is higher than the desired maximum value of 2 mole percent. However, if the condensing system is well designed and has no history of corrosion, experience shows that the criterion can be relaxed to 8 wt %.

(3) As a point of interest, one common "rule of thumb" for washing hydrocracker systems states that no less than 1 gpm water per MBPD feed should be injected. The washwater rate calculated from that rule is 556 mol/hr (20 gpm), based on 20,000 PBD feed. The resulting aqueous phase rate is 293 mol/hr at a temperature if 125° C. (258° F.). The pH of the aqueous phase is 7.18 and the mole pct of ammonium, chloride, hydrosulfide and sulfide is 1.18 (equivalent to 1.66 wt %). When the stream is cooled to 38° C. (100° F.), the pH increases to 7.89 and the ionic concentration increases to 5.61 mol % (equivalent to 7.76 wt %). Compared to the case of 649 mol/hr washwater described in (1) and (2), the resulting aqueous ionic concentration at the separator in this case is higher but still acceptable. Therefore, this washwater rate (556 mol/hr) can be treated as the minimum for washing this particular system. One must note this "1 gpm water per MBPD feed" rule does not take into consideration the variation of impurities in the feed stream. If the impurity level increases significantly, another flash calculation must be made to make sure that the current washwater rate still yields the desired results.

(4) Another "rule of thumb" for water washing hydrocracker effluent requires the mass of liquid water (aqueous) phase at the injection point be no less than 25% by weight of the total water injected. The minimum amount of water to satisfy that requirement is 380 mol/hr. The resulting aqueous phase rate is 69 mol/hr at a temperature of 126° C. (259° F.). The pH of the aqueous phase is 7.19 and the mole percent of ammonium, chloride, hydrosulfide and sulfide is 1.24 (equivalent to 1.74 wt %). When the stream is cooled to 38° C. (100 ° F.), the pH increases to 8.02 and the ionic concentration increases to 7.70 mol % (equivalent to 10.56 wt %), which means the aqueous phase may become corrosive at some location downstream of washwater injection because of the high concentration of ionic species. Therefore, the injection rate of water for this system should be at least 556 mol/hr to achieve effective washing.

TABLE 1

CHARACTERISTICS OF CONTINUOUS WATER WASH SYSTEM

| STREAM COMPONENT | LB-MOL/HR |
|---|---|
| $H_2$ | 7775 |
| METHANE | 4384 |
| ETHANE | 460 |
| PROPANE | 200 |
| ISOBUTANE | 42 |
| N-BUTANE | 42 |

TABLE 1-continued

CHARACTERISTICS OF CONTINUOUS WATER WASH SYSTEM

| STREAM COMPONENT | LB-MOL/HR |
|---|---|
| ISOPENTANE | 8 |
| N-PENTANE | 9 |
| NBP152 (0.792)* | 16.88 |
| NBP200 (0.814) | 11.26 |
| NVP240 (0.825) | 14.45 |
| NBP270 (0.835) | 8.56 |
| NBP290 (0.84) | 9.54 |
| NBP310 (0.85) | 10.56 |
| NBP330 (0.852) | 11.67 |
| NBP350 (0.84) | 19.95 |
| NBP370 (0.85) | 31.85 |
| NBP390 (0.85) | 40.95 |
| NBP425 (0.87) | 165 |
| NBP474 (0.88) | 197 |
| NBP525 (0.895) | 198 |
| NBP575 (0.90) | 185 |
| NBP625 (0.91) | 113.6 |
| NBP675 (0.93) | 65 |
| NBP750 (0.96) | 15 |
| NBP850 (0.97) | 2 |
| HYDROGEN SULFIDE | 265 |
| AMMONIA** | 17.86 |

*Average boiling point is listed for every cut, so is the specific gravity. NBP152 (0.792) represents a cut with the average boiling point equal to 152° F. and specific gravity equal to 0.792.
**based on 1000 ppm N in the feed Data and Other Pertinent Information Process simulators used in this example are SIMSCI, from Simulation Sciences Inc., Fullerton, Calif., and Electro-chem, from OLI Systems, Inc., Morris Plains, N.J.

DISCUSSION

Our process may be used in many ways. One simple and effective use is to calculate if salt deposition will be a problem even without water injection. In some refinery streams, salt deposits may not form in the region studied. This might be because temperatures are so high, or impurity concentrations so low, that no salts or impurities deposit. Salts may also deposit but there may be enough native water present so that no additional water injection is needed.

It is also possible to omit this step (calculating what happens with no water injection) and presume that some water injection will be needed at some point in the line or piece of equipment being considered, just based on operating experiences. If the calculations show that the resulting salt solution is very dilute, that would be a sign that the calculation should be repeated with a lower initial water injection rate.

Although we prefer to start our calculations with a relatively low amount of water and increase the amount of water injected, it is also possible to do the reverse. Thus for purposes of starting the calculations one could inject some excessive amount of water, say equal to 10 or 25 wt % of the process stream, and reduce water injection from this initial high rate. With modern computers and software to do this work both approaches can be made to work. In the high initial injection case the water injection rate could be reduced until the ion concentration limit, or the water/oil limit of 3 wt % of any oil phase formed, is reached.

There still may be a place for "rules of thumb" even using our method to calculate how much water injection is needed.

By this we mean that it will be prudent to begin water injection into the process line or vessel well before the calculations show salt depositing. Depending on the process stream, and local conditions, refiners may add a 5° or 10° F. cushion to the minimum water injection temperature. Thus if our chemical speciation calculations indicate that salts would start to come out at 195° F. in the overhead line, it might be prudent to begin water injection at a point in the overhead line where the temperature is 205° F., so that salt deposits (and possible underdeposit corrosion) will not occur during blizzards or thunderstorms. Similarly, refiners may choose to add 110% or 125% or more of the minimum amount of water needed to dissolve all projected salt deposits. These cushions regards amounts and the place of water injection are simply new "rules of thumb", but much more intelligent ones than those heretofore used. There will still be a place for art in water washing, but science will predominate.

One of the most important features is the ability to check for transient regions of low pH where corrosion may occur. Refiners now look at the pH of the water in the boot of the V/L separator associated with the process unit, and presume that if this water is not corrosive then there is no corrosion problem. This is a serious, and completely avoidable, condition. Our approach makes it easy to determine by calculations, rather than experimentation, if a corrosive condition develops downstream of the water injection point but does not show up in the water drained from the boot. The remedy, when such a corrosive transient is noted, will usually involve addition of more water, or changing the pH of the water. At the least the discovery of transient corrosive regions will indicate the need for more frequent and/or more intense inspection of the affected region.

While this condition (transient corrosive solutions, which are not corrosive in the boot) is not common, it can occur in many process streams, and will cause serious problems when it occurs. Preventing such transients is similar to equipping a car with seat belts and/or air bags, they may not be needed and frequently people do not realize such equipment is there until it is needed and prevents a catastrophe.

DISCLAIMER AND CAUTIONARY NOTICE

Our process can be used to supplement conventional safety practices, not to replace them. We do not want our technology to lull refiners or chemical plant operators into a false sense of security. Refiners should not assume that because routine problems associated with water washing can be eliminated there will be no problems in this area.

Refineries and petrochemical plants are filled with volatile and potentially explosive and/or toxic materials. A failure in a propane line can, in seconds, create a vapor cloud which will expand until it reaches an ignition source (such as the many fired heaters located near the process). Such vapor clouds have exploded with catastrophic results including loss of many refinery units and much injury and death.

Our approach to water washing is better than anything now available, and vastly superior to conventional "rules of thumb" but it does not eliminate risk. Our system should never be considered a substitute for normal refinery inspection practice. Annual inspections of all critical areas of each refinery unit will still be needed for safety.

Thus while our process will help predict some areas where problems are likely to occur, it must never be used as a substitute for conventional prudent inspection practice and other normal safety practices.

Part of the reason for our caution is that new processes, new catalysts, and old problems (operator error or equipment failure or miscalibration) are always with us. A water injection program that is appropriate for normal operation may be completely inadequate if a few barrels of caustic or other corrosive chemical are mixed with the feed, or show up in the wash water. Water injection pumps may fail or be shut off, feed properties may change, or a new batch of catalyst may be overchlorinated. Even if the process runs perfectly and the catalyst never changes the feed properties may change, or a laboratory analysis of feed properties may be in error. Any of these could lead to an incorrect amount of water injection and a corrosion and/or fouling problem.

Our approach is purely based on thermodynamics. Important kinetic aspects, such as flow patterns and residence time, are beyond the scope of our work.

Our method is not intended to handle localized, unusual conditions, such as hot process lines which have relatively cold spots due to poor insulation or rain water dripping on a line. A water injection nozzle may be partly plugged, causing an uneven spray and consequent localized regions of high or low temperature. Even perfect nozzles may create localized regions of unusual pH or chemical composition around the nozzle that are difficult to calculate or even estimate.

Our process will help refiners avoid many problems heretofore created by relying on "rules of thumb" for water injection. We can even use our technology to help locate some, but not all, areas which merit more frequent inspection. Our technology should never be used to reduce or eliminate any customary inspections currently used.

While our process will not solve all problems it will effectively allow refiners and petrochemical plant operators to practice water washing without creating more problems. Many of the steps taken are simple, and may even seem obvious in retrospect, but we have never seen or heard of a publication which describes our approach to water washing. Not only have we not heard anyone else propose our solution, but we regularly hear of serious salt plugging and corrosion problems from all of our refineries, most of which could be completely eliminated by using our approach to water washing.

We claim:

1. A process for injecting water into a process stream, flowing from an inlet at a temperature to an outlet at a lower temperature, which contains salts, salt precursors or compounds which form deposits of impurities upon cooling comprising:

a. determining the composition of said impurities in said process stream;

b. calculating an initial deposition temperature at which said impurities will start to deposit in said process stream;

c. selecting an initial water injection rate and a starting point for water injection in said process stream where said process stream temperature has a starting point temperature which is the higher of:
a temperature less than 350° F., or
said initial deposition temperature;

d. calculating for said process stream at said starting point of water injection an adiabatic flash temperature using said initial water injection rate and said starting point stream temperature;

e. calculating if sufficient water was injected to produce in said process stream an aqueous phase satisfying both of the following conditions:
an amount equal to at least 3 wt % of any liquid hydrocarbon phase which may form or be present, and
an ion concentration less than a maximum mole %;

f. repeating said adiabatic flash calculation with an adjusted water injection rate until both of said conditions are satisfied;

g. accepting as a designated amount of water injection an amount of water which produces an aqueous phase equal to at least 3 wt % of any hydrocarbon phase present or formed and having an ion concentration no more than said maximum mole %; and h. injecting said designated amount of water into said process stream at said starting point for water injection.

2. The process of claim 1 wherein chemical speciation calculations are used to determine the concentration of ions in said aqueous phase.

3. The process of claim 1 wherein said maximum ion concentration in said aqueous phase is 2 mole %.

4. The process of claim 1 wherein said ion concentration and a pH of said resulting aqueous phase are calculated using the following procedure:

a. determine the composition of impurities in said process stream and in said injected water;

b. perform speciation calculations by calculating:
HA=A(−)+H(+)* with an equilibrium constant K equal to a concentration of A(−)* concentration of H(+)/concentration of HA;

c. calculate the sum of ions in said aqueous phase by adding:
chloride ions
ammonium ions
hydrosulfide ions, and
sulfide ions; and d. calculate a hydrogen ion concentration and pH in said resulting aqueous phase.

5. The process of claim 1 wherein a pH in said aqueous phase resulting from injecting said designated amount of water at said starting point for water injection is calculated and compared to a target pH in the range of 5.5 to 7.5 and said designated amount of water is increased to achieve a pH within the target range.

6. The process of claim 1 wherein a pH in said aqueous phase resulting from injecting said designated amount of water at said starting point for water injection is calculated and compared to a target pH in the range of 5.5 to 7.5 and a pH control chemical is injected into said process stream or with said injected water to achieve a pH within the target range.

7. The process of claim 1 further characterized by checking for transient conditions of ion concentration at an intermediate point of said process stream downstream of said initial point of water injection upstream of said outlet by:

a. performing at least one adiabatic flash temperature and chemical speciation calculation at an intermediate temperature corresponding to at least one location of said process stream downstream from said starting point for water injection but at a temperature greater than or equal to a terminal process temperature at which water separation and removal occurs; and b. increasing said designated amount of water injection and repeating said calculation until said resulting aqueous phase has an ion concentration of no more than 2 mole %.

8. The process of claim 1 further characterized by checking for transient conditions of pH at an intermediate point of said process stream downstream of said initial point of water injection and upstream of said outlet by:

a. performing at least one adiabatic flash temperature and chemical speciation calculation at an intermediate temperature corresponding to at least one location of said process stream downstream from said starting point for water injection but a temperature greater than or equal to a terminal process temperature at which water separation and removal occurs; and b. calculating a pH in said aqueous phase at said intermediate temperature and comparing same to a target pH in the range of 5.5 to 7.5; and c. adjusting pH at said point by at least one of:
injecting more water,
injecting a pH control chemical with said injected water, and
adding a pH control chemical to said process stream,
to achieve a pH within the target range in said aqueous phase at said intermediate temperature.

9. The process of claim 1 wherein an adiabatic flash calculation and ion concentration calculation are performed at said outlet temperature and a pH in said aqueous phase at said outlet temperature is calculated and compared to a target pH in the range of 5.5 to 7.5 and said pH is controlled by adjusting pH at said point by at least one of:
injecting more water,
injecting a pH control chemical with said injected water, and
adding a pH control chemical to said process stream,
to achieve a pH within the target range in said aqueous phase at said outlet temperature.

10. The process of claim 1 wherein said process stream is a vapor.

11. A process for determining a minimum temperature in a flowing process stream at which water washing must be initiated to prevent solid deposits of impurities, defined as at least one salt or salt precursor selected from the group of HCl, $NH_3$, and $H_2S$ and mixtures thereof which form solid deposits upon cooling, said process stream flowing through a line or vessel from an inlet at an inlet temperature and inlet pressure to an outlet at a lower temperature and an outlet pressure comprising:

a. analyzing said process stream to determine a concentration of HCl, $NH_3$ and $H_2S$;

b. selecting an initial water injection point in said flow line or vessel and determining a process stream initial temperature and initial pressure at said initial water injection point;

c. calculating, by an isothermal flash calculation at said initial temperature and pressure, the partial pressures of HCl, $NH_3$ and $H_2S$;

d. determining a product of said partial pressures:

$$P(HCl)*P(NH_3),$$

and $$P(NH3)*P(H_2S)$$

where P(HCl), $P(NH_3)$, and $P(H_2S)$ represent the partial pressures of HCl, $NH_3$ and $H_2S$, respectively;

e. comparing said partial pressure products with a corresponding equilibrium constant at the same temperature to determine if the vapors are stable phases or will cause salt deposition;

f. reducing said initial temperature to a reduced initial temperature if products of said vapor phases produce stable vapor phases and repeating said isothermal flash calculations until a salt deposition temperature is reached at which an unstable vapor phase is indicated which causes salt deposition;

g. selecting a minimum temperature for water injection which is greater than said salt deposition temperature; and h. injecting water into said flowing process stream at a point in said line or vessel where a temperature of said process stream is greater than or equal to said minimum temperature.

12. The process of claim 11 wherein said minimum temperature is at least 5° C. higher than said salt deposition temperature as a safety factor to ensure that water washing occurs upstream of any region of potential salt deposition.

13. The process of claim 12 wherein said minimum temperature is at least 10° C. higher.

14. The process of claim 11 wherein $$P(HCl)*P(NH_3),$$

and $$P(NH_3)*P(H_2S)$$

are calculated using equations (1) through (5) in the specification to determine if the vapors are stable phases or will cause salt deposition.

15. The process of claim 11 wherein, in addition to calculating a minimum temperature of said process stream for water injection, a minimum amount of water injection at a selected minimum temperature is calculated by:

selecting an initial water injection rate;

performing an adiabatic flash calculation based on said initial water injection rate in said process stream at at least said selected minimum temperature to calculate a flash temperature and check for the presence of an aqueous phase which:

i. forms in an amount equal to at least 3 wt % of any hydrocarbon phase which may form or be present, and ii. has a dissolved ion concentration no greater than a maximum mole %, based on chemical speciation calculations on said aqueous phase at said flash temperature; and repeating said adiabatic flash and chemical speciation calculations with an increased amount of water injection as necessary to produce an aqueous phase equal to at least 3 wt % of any hydrocarbon phase formed or present and having a dissolved ion concentration no greater than said maximum mole %; and selecting a water injection rate which is at least as large as said increased amount of water injection.

16. The process of claim 15 wherein said maximum ion concentration in said aqueous phase is 2 mole %.

17. The process of claim 15 wherein said maximum ion concentration is based only on a calculation of the amount of $NH_4$, Cl—, HS— and $S^{2-}$ in said aqueous phase.

* * * * *